US005107304A

United States Patent [19]

Haneda et al.

[11] Patent Number: 5,107,304

[45] Date of Patent: Apr. 21, 1992

[54] REMOVABLE CARTRIDGE FOR A COLOR IMAGE FORMING APPARATUS

[75] Inventors: Satoshi Haneda; Masakuzu Fukuchi; Hisashi Shoji; Shunji Matsuo; Shizuo Morita, all of Tokyo, Japan

[73] Assignee: Konica Corporation, Tokyo, Japan

[21] Appl. No.: 480,664

[22] Filed: Feb. 15, 1990

[30] Foreign Application Priority Data

Feb. 21, 1989 [JP] Japan ..... 1-40647

[51] Int. Cl.[5] ..... G03G 21/00

[52] U.S. Cl. ..... 355/296; 355/210; 355/297; 355/299; 355/301; 355/327

[58] Field of Search ..... 355/200, 260, 296, 298, 355/299, 210, 215, 301, 302, 303, 304, 305, 326, 327, 297; 206/216, 518

[56] References Cited

U.S. PATENT DOCUMENTS

| | | | |
|---|---|---|---|
| 3,848,992 | 11/1974 | Smith | 355/299 |
| 4,400,081 | 8/1983 | Yamashita et al. | 355/299 |
| 4,451,139 | 5/1984 | Yanagawa et al. | 355/297 |
| 4,462,677 | 7/1984 | Onoda | 355/210 |
| 4,540,268 | 9/1985 | Toyono et al. | 355/210 |
| 4,708,455 | 11/1987 | Kubota et al. | 355/260 X |
| 4,803,518 | 2/1989 | Haneda et al. | 355/327 X |
| 4,924,267 | 5/1990 | Yoshikawa et al. | 355/210 |
| 4,974,020 | 11/1990 | Takamatsu et al. | 355/299 X |

FOREIGN PATENT DOCUMENTS

| | | | |
|---|---|---|---|
| 0080680 | 5/1983 | Japan | 355/215 |
| 0215516 | 6/1984 | Japan | 355/299 |
| 0085781 | 4/1988 | Japan . | |

*Primary Examiner*—A. T. Grimley
*Assistant Examiner*—J. E. Barlow, Jr.
*Attorney, Agent, or Firm*—Finnegan, Henderson, Farabow, Garrett and Dunner

[57] ABSTRACT

A color image forming apparatus having an image retainer, a cleaning device for removing residual toner particles on the image retainer, and a device for releasing the cleaning device from the image retainer, which are integrally constructed as a process unit and can be taken out from an apparatus body. The cleaning device is in pressure contact with the image retainer when the process unit has been taken away. The device for releasing the cleaning device is mounted on the apparatus body.

8 Claims, 6 Drawing Sheets

REMOVABLE CARTRIDGE FOR A COLOR IMAGE FORMING APPARATUS

BACKGROUND OF THE INVENTION

The present invention relates to a color image forming apparatus using the electrophotography, and, more particularly, to a color image forming apparatus constructed such that a cleaning device together with an image retainer are mounted detachably on an apparatus body.

In order to form color images by the electrophotography, there have been proposed a number of methods and apparatus. In one of these methods, as disclosed in Japanese Patent Laid-Open No. 61-100770, for example, a color copy is obtained by forming and developing latent images according to the separated color number of a document image on an image retainer such as a photosensitive drum, by transferring each image developed to a transfer drum to form a multi-color image on the transfer drum and further transferring it to a recording paper. The apparatus using this method is required to have a transfer drum having such a size as to allow one image to be transferred to its circumference in addition to the photosensitive drum. As a result, the apparatus cannot be freed from a large size and a complicated structure.

As disclosed in Japanese Patent Laid-Open No. 61-149972, on the other hand, there is another method for forming a multi-color copy by forming and developing latent images according to a separated color number of a document image on a photosensitive drum and by transferring the images upon the individual developments to a transfer material. However, this method finds it difficult to overlap the multi-color images accurately so that an excellent color copy cannot be obtained.

There is still another method for forming a color image by repeating both formations of latent images according to a separated color number of a document image on a photosensitive drum and developments of the same with color toners for superposing the color toner images on the photosensitive drum and then transferring the same. The fundamental process of this multi-color image formations is disclosed in Japanese Patent Laid-Open Nos. 60-75850, 60-76766, 60-95456, 60-95458 or 60-158475.

In this multi-color image forming apparatus for forming a color image by such superposition, the photosensitive drum is surrounded around its circumferential edge by a plurality of developing devices which are stored with color toners of different colors. Generally speaking, the photosensitive drum is turned several times to develop the latent images thereon thereby to form a color image.

For the existing reproducing machine, on the other hand, there has been a proposal in which a photosensitive drum, a developing device and a cleaning device are mounted altogether on a support member to facilitate the replacements and remedies of the individual units, as disclosed in Japanese Patent Laid-Open No. 58-54392. For the monochromatic image, on the other hand, those devices are made integral and disposable to facilitate their replacements, as disclosed in Japanese Patent Laid-Open No. 57-154255. For the disposable cartridges for color images, moreover, there is disclosed in Japanese Patent Laid-Open No. 58-72159 a color cartridge which has a plurality of built-in developing devices to be disposed integrally.

No matter what structure might be taken, however, the multi-color image forming apparatus for forming a color image by superposing toner images of different colors while the photosensitive drum is rotated plural turns cannot be constructed such that the individual cleaning members (such as blade) composing the cleaning device are forced to contact with the photosensitive drum surface at all times, but requires a function to bring the cleaning members apart from the photosensitive drum surface, when the toner images are superposed. If, more specifically, the cleaning members (especially, blade) are always held in abutting contact with the photosensitive drum, the following troubles will occur:

(1) The photosensitive drum is deformed to have its photosensitive characteristics changed;

(2) The cleaning member (blade) and the photosensitive drum are attached with the toners; and (3) The cleaning member is formed (For example, the cleaning blade is deformed to have its abutting pressure changed, or the fur brush itself is deformed).

A device for bringing the cleaning members into and out of contact with the drum surface is advisably disposed at the side of the body of the image forming apparatus rather than the side of the cleaning device because of mechanical and electrical connections between the body of the image forming apparatus and the cleaning device.

In such construction, however, the cleaning member is supported only by the supporting member and becomes unstable when the cleaning device is taken out from the body of the image forming apparatus, because the cleaning device has no device for bringing the cleaning member into and out of contact with the drum surface.

This raises a problem that the toners on the cleaning members drop from the clearance between the cleaning members and the drum, when the aforementioned process unit wherein the photosensitive drum is integrated with the cleaning device is to be taken out from the apparatus body, to blot the inside of the apparatus body and the surface of the floor. Another problem is that the photosensitive drum itself is seriously instable when it is disengaged from the apparatus body.

SUMMARY OF THE INVENTION

The present invention has been conceived to solve the above-specified problems and has an object to provide a color image forming apparatus enabled to mount and demount a process unit wherein a photosensitive drum is integrated with a cleaning device, on and from an apparatus body in a stable state while being kept clean away from the drop or scatter of toners.

The above-specified object of the present invention can be achieved by a color image forming apparatus of the type, in which an image retainer and cleaning means having a mechanism for releasing the cleaning means from the image retainer are integrally constructed as a process unit and can be taken out from an apparatus body, characterized in that said cleaning means is in pressure contact with said image retainer when said process unit has been taken away.

Other objects and features of the present invention will become apparent from the following description to be taken with reference to the accompanying drawings.

DESCRIPTION OF THE PREFERRED EMBODIMENT

As one embodiment of the present invention, there will be described a multi-color image forming apparatus which uses a color image forming method resorting to a toner superposition developing system, as disclosed in Japanese Patent Laid-Open No. 60-75850.

Figure 1:
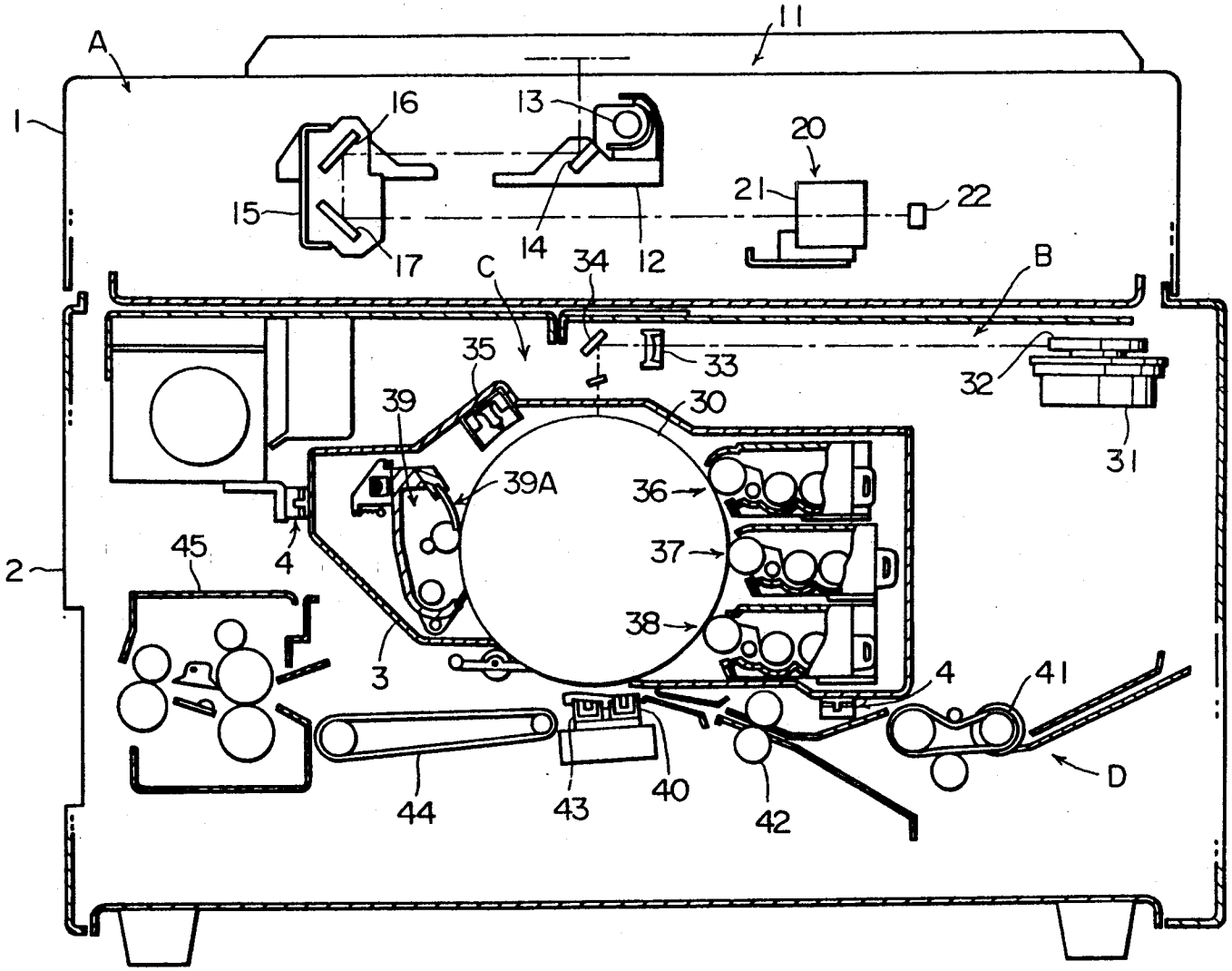
FIG. 1 is a sectional view showing a color image forming apparatus according to the present invention.

FIG. 1 shows a major structure of the color image forming apparatus, which is constructed of an image reading unit A, a laser writing unit B, an image forming unit C and a paper feed unit D so that a color image is formed by the following process.

In the aforementioned reading unit A, reference numeral 11 designates a document glass plate for holding a document. This document is illuminated with a halogen lamp 13 which is carried by a carriage 12 adapted to slide in the horizontal directions. A moving mirror unit 15 is equipped with mirrors 16 and 17 and also adapted to slide in the horizontal directions so that it may be combined with a mirror 14 to lead out an optical image of the document to a lens reading unit 20.

The aforementioned carriage 12 and movable mirror unit 15 are driven through wires connected to stepping motors (although both are not shown) so that they are slid in the same direction at the velocities of V and ½ V, respectively.

The aforementioned lens reading unit 20 is composed of a lens 21 and a color CCD 22.

The optical image of the document transmitted by the aforementioned mirrors 14, 16 and 17 is converged and focused on the light receiving face of the color CCD 22 by the aforementioned lens 21.

Image signals B, G and R outputted from the aforementioned CCD 22 have their colors compensated in a signal processing unit. In this signal processing unit, color signals having their colors compensated in accordance with colors of Y, M and C toners are outputted to the afore-mentioned laser writing unit B acting as an exposure means.

In this laser writing unit B, a laser beam is rotationally scanned by a polygon mirror 32, which is turned by a drive motor 31, and is guided through an f$\theta$ lens 33 until its optical path is deflected by a mirror 34. Thus, the laser beam scans the circumference of an image retainer 30 which has been electrically charged in advance by a charging device 35 acting as charging means.

If, in this meanwhile, the scanning operation is started, the beam is detected by an index sensor so that its modulations by a first color signal are started to scan the circumference of the afore-mentioned image retainer 30 with the modulated beam. As a result, a latent image corresponding to the first color is formed on the circumference of the image retainer 30 by the main scan with the laser beam and by the auxiliary scan of the rotations of the image retainer 30. This latent image is developed by a developing device 36 of the developing means, which is charged with Yellow (Y) toner, so that a toner image is formed on the image retainer. The toner image thus obtained is carried, while being retained on the image retainer below a cleaning device 39, which is apart from the circumference of the image retainer 30 to act as the cleaning means, until it enters a subsequent copy cycle.

Specifically, the image retainer 30 is charged again by the aforementioned charging device 35, and a second color signal outputted from the signal processing unit is then inputted to the aforementioned writing unit B so that the circumference of the image retainer is formed with a latent image like the aforementioned case of the first color signal. This latent image is developed by a developing device 37 which is charged with a toner of a second color, e.g., Magenta (M).

The toner image of this Magenta (M) is formed in the presence of the aforementioned toner image of the Yellow color formed already.

Reference numeral 38 designates a developing device which has a toner of a Cyan (C) color to form a Cyan (C) toner image on the image retainer on the basis of an image signal generated in the signal processing unit. These individual developing devices 36, 37 and 38 have their sleeves fed with a bias of either a DC current or a superposition of DC and AC currents and are subjected to a non-contact development with two-component developers acting as the developing means so that the latent images on the image retainer 30 grounded to the earth are developed in the non-contact state.

The color image thus formed on the circumference of the image retainer 30 is transferred at a transfer electrode 40, which is provided as a transfer means, to a recording paper, which is fed from the afore-mentioned paper feed unit D by a paper feed belt 41 and a paper feed roller 42 to act as a recording medium. The recording paper having the toner images transferred thereto is separated from the image retainer by a separating electrode 43 and is conveyed through a conveyor belt 44 to a fixing device 45 so that its image is fixed.

On the other hand, the image retainer 30, which has the recording paper separated from its circumference, has its residual toners removed by the contact of a blade 39A of the afore-mentioned cleaning device 39. At the end of this removal, the blade 39A is disengaged from the image retainer so that a new process for forming the color image is entered.

Next, the layout of the aforementioned individual major components will be described in the following. As shown in FIG. 1, the aforementioned image reading unit A is accommodated in an independent exclusive casing 1 and is mounted on a later-described body 2.

In this body 2, there is assembled an image recording system which is composed of the afore-mentioned writing unit B, image forming unit C and paper feed unit D so that it receives color signals from the image reading unit A through grouped flexible cables which are connected to the casing 1.

In the body 2 thus constructed, the image retainer 30 is positioned generally at the center, and the aforementioned individual developing devices 36, 37 and 38 are arranged in horizontal positions such that they face the righthand semi-circumference of the image retainer 30. At the lefthand semi-circumference, on the other hand, there are arranged the aforementioned charging device 35 and cleaning device 39.

Figure 2:
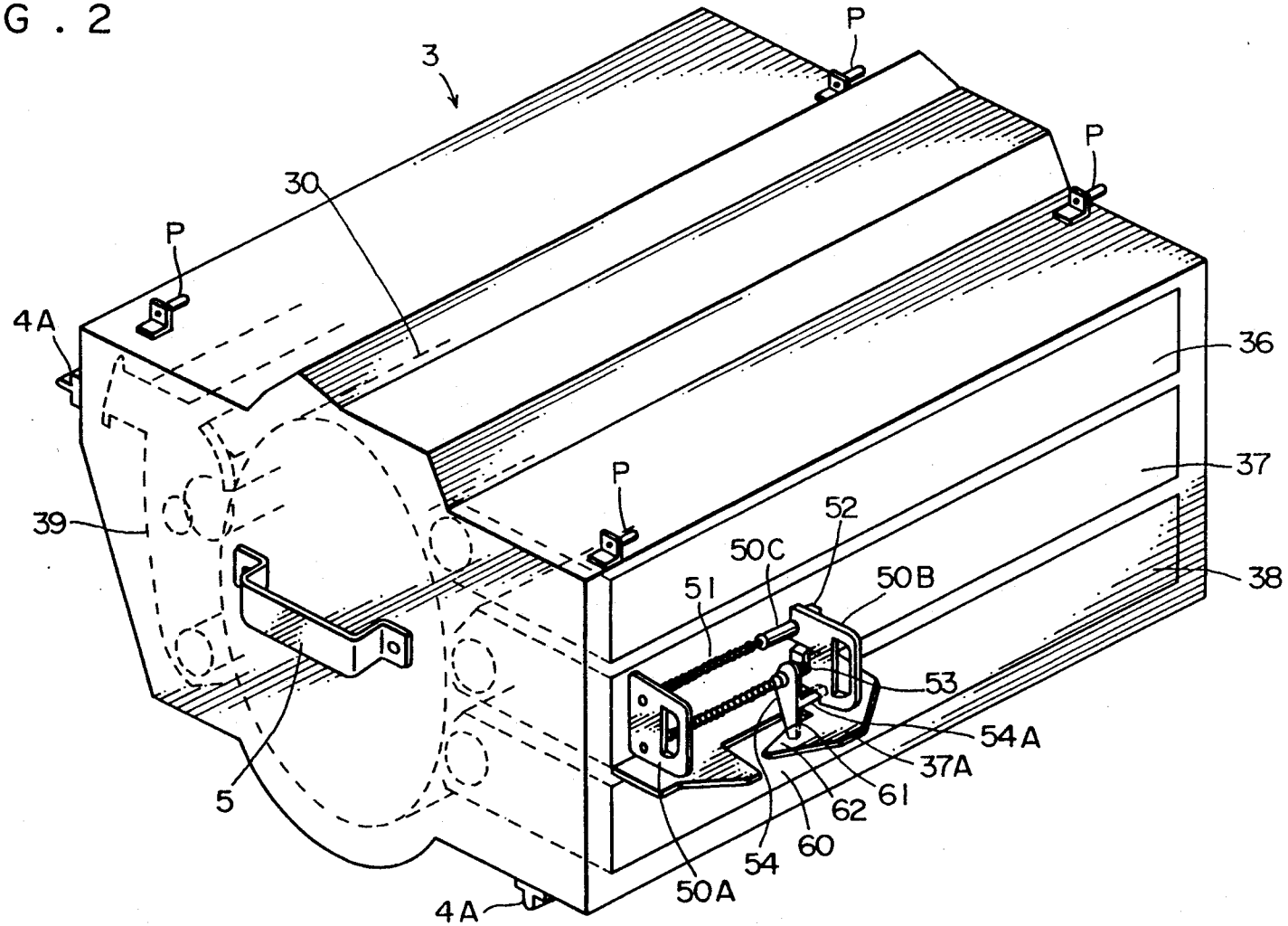
FIGS. 2 and 3 are perspective views showing the structure of a process unit of the aforementioned apparatus and a demounted state of the process unit, respectively.

The aforementioned image retainer 30, individual developing devices 36, 37 and 38 and cleaning device 39 are constructed such that they can be removed altogether as a process unit and simultaneously from the body 2, and are either directly born on or removably built in a frame or front and back walls of a cartridge 3, as shown in FIG. 2.

Figure 3:
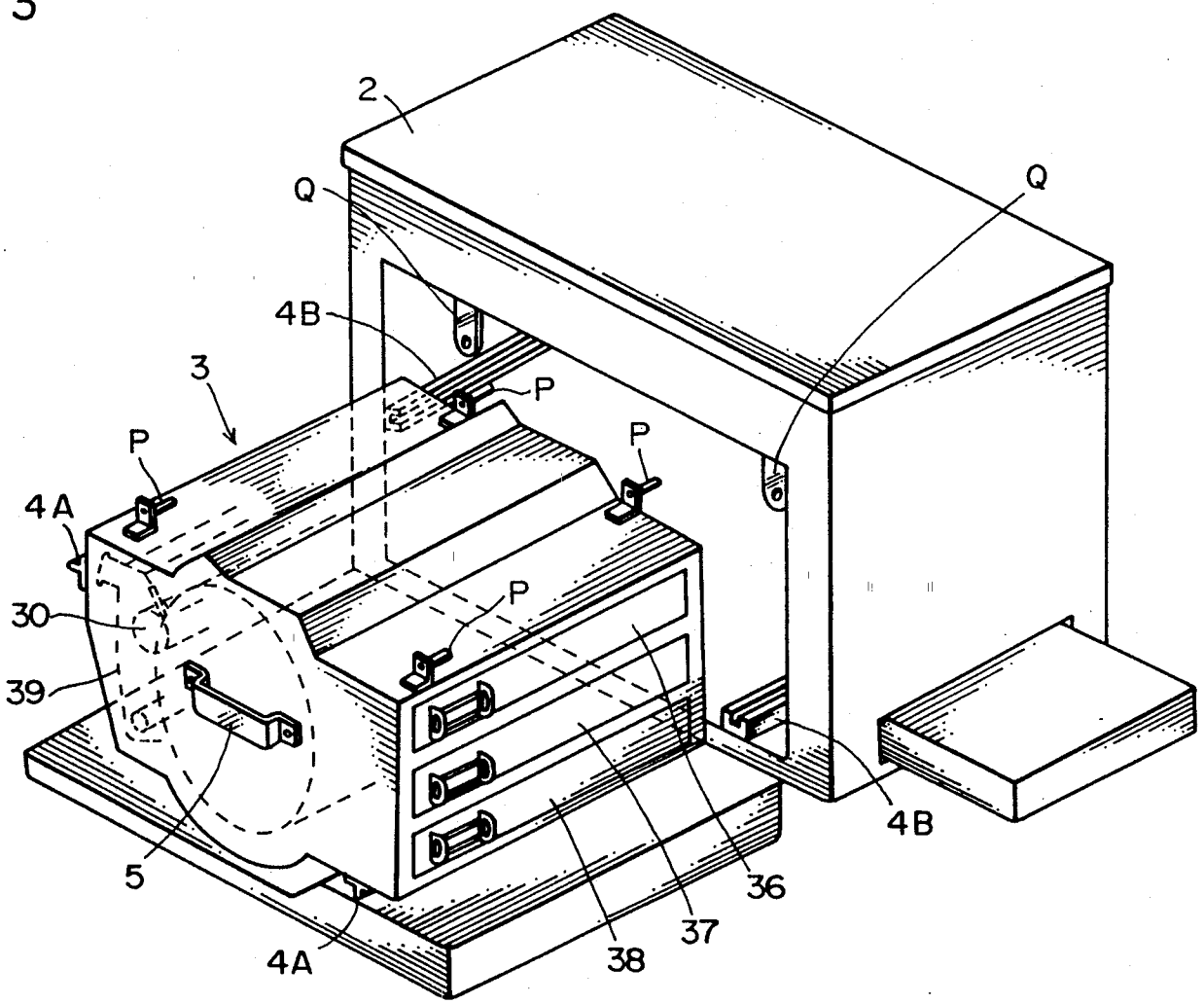

This cartridge 3 can be easily mounted or demounted at the front, as shown in FIG. 3, on or from the body 2 through a pair of guide members 4 disposed at righthand and lefthand sides.

As shown in FIGS. 2 and 3, more specifically, the aforementioned cartridge 3 is equipped with rails 4A at its righthand and lefthand side edges, and the body 2 is equipped with guide rails 4B at its positions corresponding to the rails 4A such that slidable and chargeable pairs are made when the rails 4A are brought into engagement with the guide rails 4B.

On the other hand, two pairs of righthand and lefthand reference pins P are attached to upper edges of the front and back walls of the aforementioned cartridge. Suspensions Q are made to depend from front and rear base plates of the body 2. When the reference pins P are fitted in holes of said suspensions Q, the cartridge 3 is suspended by the body 2 such that the aforementioned image retainer 30, individual developing devices 36, 37 and 38 and cleaning device 39 carried by the cartridge 3 are positioned relative to the body 2.

As a result, if a grip 5 at the front wall of the cartridge 3 is pulled, the aforementioned cartridge 3 comes out through the guide rails 4B to the front of body 2. If the grip 5 is pushed inside, on the other hand, the aforementioned reference pins P are brought into engagement with the holes of the aforementioned suspensions Q so that the aforementioned cartridge 3 is accommodated again in a suspended position within the body 2.

Thus, the aforementioned cartridge 3 is held in the suspended state relative to the base plate of the body 2 so that vibrations and shocks to be transmitted from the motors or the like of the body to the aforementioned image retainer 30, individual developing devices and cleaning device 39 are drastically damped and absorbed. Transmitted vibrations and shocks are uniformly received by the individual mechanical parts. Since the plural developing devices and the image retainer are held in the relatively uniform positions, no serious trouble will arise in the formation of the image.

The image retainer 30 and the cleaning device 39 are integrally held in the cartridge 3. There can be drastically damped and absorbed the bad influences such as the vibrations or shocks to be exerted upon the delicate forced contact, pressure state or weighing condition when the blade 39A has to be forced into or out of contact in the cleaning device 39 for developing the superposed images.

As to the individual developing devices 36, 37 and 38, on the other hand, the developing sleeves are reduced to have external diameters of 20 mmϕ without dropping the image performances, as will be described in detail hereinafter, so that their thicknesses (or heights) can be sufficiently reduced to about 30 mm or less. As a result, the four developing devices including three color and black toners, in this embodiment the developing devices 36, 37 and 38 can be integrally arranged in the horizontal positions within a space corresponding to the range of the external diameter (100 mmϕ) of the afore-mentioned image retainer 30.

Even if the aforementioned cartridge 3 is limited to the minimum height sufficient for covering the image retainer 30 in a manner to exert no influence upon the layout of the members to be attached and fixed directly to the body 2, i.e., the conveyor system members such as the laser writing unit B, the lower transfer electrode 40 and the separating electrode 43, it can mount and accommodate not only the aforementioned cleaning device 39 but also all the plural developing devices 36, 37 and 38. As a result, a conveyor passage for the recording paper can be made generally straight to prevent the jamming effectively and to suppress the jamming, if any.

The individual developing devices 36, 37 and 38 to be used have the following structures.

The developing devices 36, 37 and 38 of the present embodiment are made to have a common structure and will be described with reference to a sectional view of the developing device 37 shown in FIG. 4.

Figure 4:
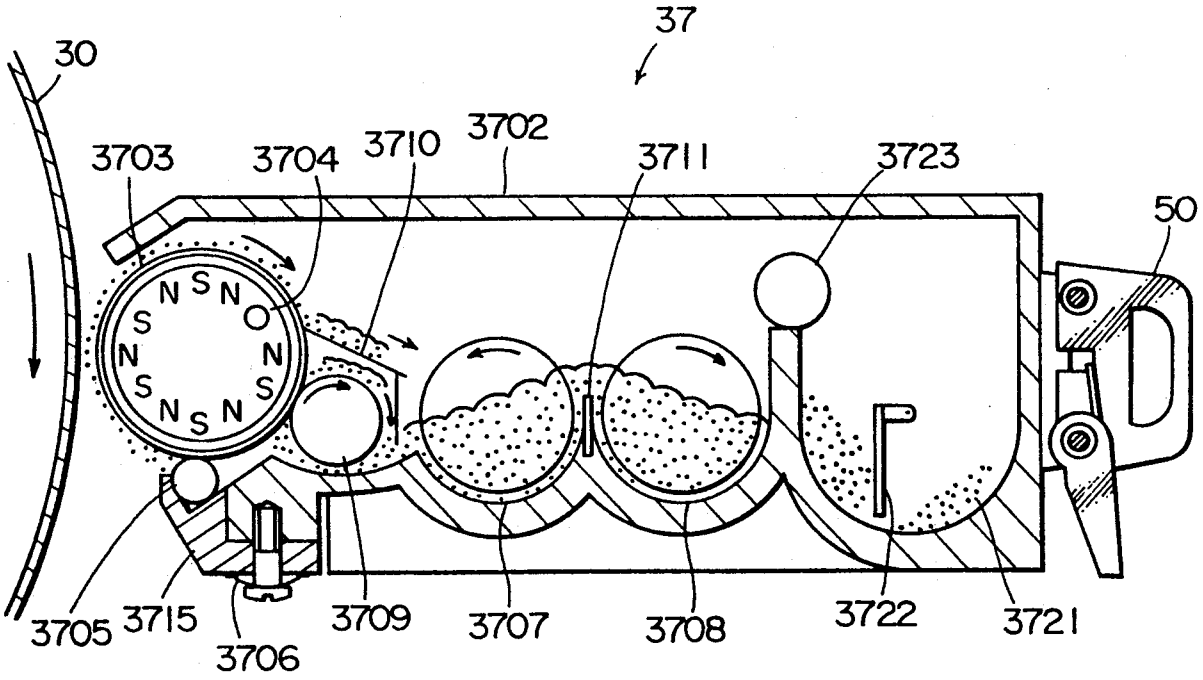
FIG. 4 is a sectional view showing a developing device to be mounted in the aforementioned process unit.

In FIG. 4: reference numeral 30 designates the image retainer; numeral 3702 a housing; numeral 3703 a developing sleeve; numeral 3704 a magnet roller; numeral 3705 a rigid and magnetic bar (e.g., cylindrical rod) for regulating the amount of the developer; numeral 3715 a holder for holding the cylindrical rod 3705; and numeral 3706 a spring member for urging the cylindrical rod 3705 to the developing sleeve 3703 to convey the developer. Thus, the cylindrical rod 3705 is urged to the developing sleeve 3703, if it were not any intervening developer, under a constant load by the spring member 3706. Numerals 3707 and 3708 are first and second agitating members; numeral 3709 a feed roller; numeral 3710 a scraper; and numeral 3711 an agitation partition. Moreover, numeral 3721 a toner supply unit; numeral 3722 a toner supply rotor; numeral 3723 a sponge roller; and numeral 50 a knob. A toner in the toner supply unit 3721 is supplied to a developer agitating unit by the coactions between the rotating toner supply rotor 3722 and the sponge roller 3723.

The toner thus supplied to the agitating unit is sufficiently agitated and blended with carrier by the coactions between the first agitating member 3707 rotating in the direction of arrow and the second agitating member 3708 rotating in the opposite direction but in an overlapping manner, so that they are fed as the developer to the developing sleeve 3703 through the supply roller 3709.

The aforementioned first agitating member 3707 and second agitating member 3708 are screw members which have counter-clockwise helical angles to rotate in the opposite directions, as indicated by arrows. The toner and its carrier once conveyed depthwise by the thrust of the second agitating member 3708 are sequentially allowed to ride over the aforementioned agitation partition 3711, which has its upper edge sloped downhill depthwise of the drawing, to the first agitating member 3707. The toner and carrier are conveyed back to this side of the drawing by the thrust of the first agitating member 3707 so that they are frictionally charged by their mixing actions to prepare a homogeneous developer. This developer is then applied in a layer to the circumference of the developing sleeve 3703 by the action of the spongy supply roller 3709 rotating in the direction of arrow.

The individual developing devices 36, 37 and 38 thus constructed are assembled into the cartridge 3 of FIG.

2 by a later-described amounting mechanism such that they can be easily demounted.

The description will proceed in the case of the developing device 37. At the back of the developing device 37, there are mounted a pair of upper and lower guide pins 51, on which are fitted compression springs. Guide pins 51 are mounted between a stationary knob 50A and a holding member 52 to urge rightward a movable knob 50B which is slidably fitted on the individual guide pins 51.

The movable knob 50B is fitted and supported on the aforementioned guide pins 51 by a pair of upper and lower bosses 50C, of which the lower one bears a push lever 54 which in turn is urged counter-clockwise by a torsion spring 53.

To the aforementioned cartridge 3, on the other hand, there is fixed a guide plate 37A for mounting the developing device 37 thereon. The guide plate 37A is formed with a "hook-shaped" notch 60 at its side end corresponding to the aforementioned push lever 54.

In a state in which the developing device 37 is mounted on the cartridge 3, the push lever 54 abuts against a straight portion 61 of the afore-mentioned notch 60 so that it is slightly held in the clockwise direction. By the reaction due to the push lever 54 urged by the torsion spring 53 and abutted against the straight portion 61, the developing device 37 is pushed toward the image retainer 30 to hold a gap (Dsd) between the image retaining surface and the developing sleeve at a regulated value.

When the developing device 37 is to be removed from the cartridge 3, on the other hand, the afore-mentioned movable knob 50B is slid so leftward against the action of the compression spring that it is gripped to the aforementioned stationary knob 50A. Then, the push lever 54 is returned counter-clockwise, after it has reached a sloped portion 62, until it is stopped to have its projection 54A abutting against the movable knob 50B.

As a result, if the individual knobs 50A and 50B are simultaneously pulled at the position where the aforementioned boss 50C pushes the aforementioned compression springs to their extremities, the aforementioned push lever 54 comes out of the opening of the aforementioned notch 60 so the developing device 37 can be demounted and separated from the cartridge 3.

When the developing device 37 is to be mounted on the cartridge 3, on the other hand, its leading end is placed on the aforementioned guide plate 37A and pushed by the stationary knob 50A. Then, the aforementioned push lever 54 on the movable knob 50B, which has been positioned at the righthand end of the guide pins 51 by the actions of the compression springs, comes into abutment against the sloped portion 62 of the front side so that it is slid leftwardly together with the movable knob 50B along the guide pins 51 by its angle of inclination.

If the developing device 37 is further pushed when the push lever 54 reaches the opening of the notch 60, the aforementioned movable knob 50B is slid rightward by the actions of the compression springs so that the push lever 54 comes into the sliding contact with the aforementioned sloped portion 62. Then, the push lever 54 is slightly turned clockwise to reach the aforementioned straight portion 61 so that the aforementioned developing device 37 is in the urged state. Here, the remaining developing devices 36 and 38 are mounted on or demounted from the cartridge by similar mounting mechanisms. As has been described hereinbefore, the knob 50 (50A and 50B) not only include releasing and locking mechanisms for the insertion and removal but also can be used to grip small-sized light developing devices so that they can enjoy effective operabilities. The positions of these knobs should not be limited to those of the embodiments in accordance with the states, in which the cartridge is extracted, or the weight balance of the developing devices but may be located one at the center or two at the righthand and lefthand sides.

When the individual developing devices 36, 37 and 38 are to be mounted on the aforementioned cartridge 3, fool-proof mechanisms are taken, in which the mounting of a developing device belonging to another kind is prevented by the individual dimensions such as the sizes of length, depth or width and the relative positions, one or more combinations of the mechanical elements between grooves, holes or notches and projections such as dowels or rails, and by the fitting mechanism selecting the aforementioned dimensions.

Figure 5:
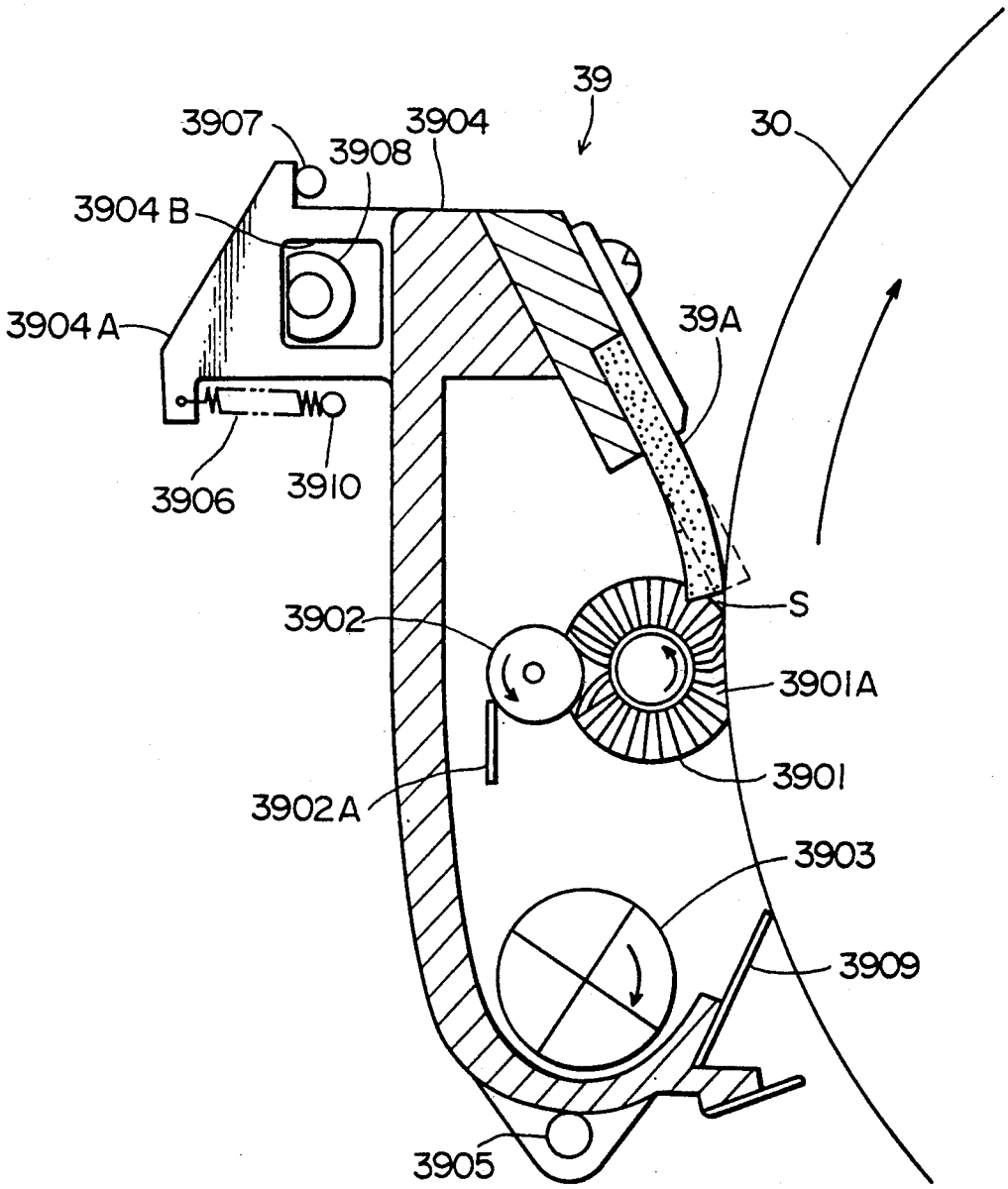
FIGS. 5(*a*) and 5(*b*) are sectional views showing respective operating states of a cleaning device to be mounted in the aforementioned process unit.
Figure 5:
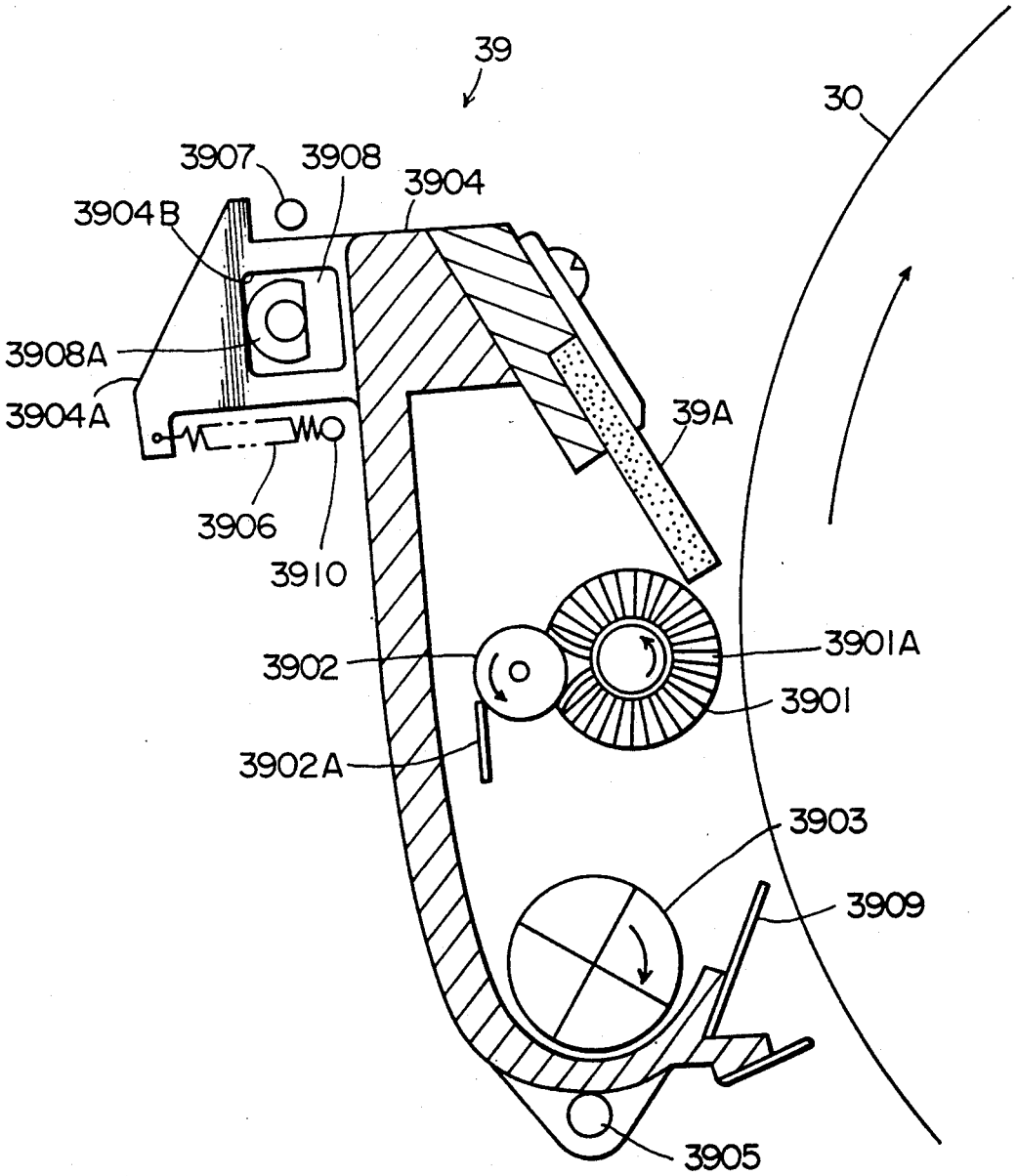

On the other hand, the aforementioned cleaning device to be used in the present embodiment has a structure in which a later-described individual cleaning members including the aforementioned blade 39A can be forced into and released from contact with the image retainer 30, as shown in FIGS. 5(*a*) and 5(*b*).

In FIG. 5(*a*), reference numeral 3901 designates a rotating brush member which is coactive with the aforementioned blade 39A for accomplishing an auxiliary cleaning operation. Numeral 3902 designates a metal roller which is rotatable while being held in light contact with said rotating brush member 3901. Numeral 3903 designates a toner conveyor screw for conveying and recovering toner dropped. These cleaning members are disposed inside of a frame 3904 which is rotatably supported by a rocking shaft 3905 extending back and forth through the aforementioned cartridge 3.

The aforementioned frame 3904 is integrally formed with a pair of front and rear projections 3904A at an upper portion of its lefthand side. Tensile springs 3906 are mounted under tension between the projections and pins 3910 which are fixed on the cartridge 3 so that the frame 3904 is biased clockwise on the aforementioned rocking shaft 3905 for the cleaning operation.

The deeper one of the aforementioned projections 3904A is formed with a square hole 3904B, in which is inserted a cam member 3908 disposed in the apparatus body and composed of a cylindrical surface and a flat surface.

The cam member 3908 thus constructed is intermittently driven and rotated by one half turn in a predetermined direction in synchronism with the timings of the image formation and the image transfer at the aforementioned image retainer 30. At the end of the image transfer, the cam member 3908 is positioned in the rotational phase, as shown in FIG. 5(*a*), so that the aforementioned frame 3904 is turned clockwise in a free state by the action of the tensile springs 3906 until it is stopped in abutment against a stopper 3907 anchored at the cartridge 3.

In this position, the frame 3904 presses the individual cleaning members on the image retainer 30 so that the aforementioned blade 39A, rotating brush member 3901 and a shielding plate 3909 fitted at the bottom of the frame 3904 are held in forced contact with the circumference of the image retainer 30 by individually predetermined pressures.

Specifically, the aforementioned blade 39A is elastically deformed from a free state, as shown by broken lines in FIG. 5(*a*), into a pressed state, as indicated by solid lines, so that it is forced by its reaction into contact with the surface of the image retainer 30 to eliminate and clean the residual toner as the image retainer 30 rotates.

The aforementioned rotating brush member 3901 is disposed upstream of the blade 39A in the rotating direction of the image retainer 30 and in a position to be forced into contact with the image retainer 30 with a nip width of about 2 to 5 mm. The brush member 3901 rotates on the circumference of the image retainer 30 to scrape off the residual toner from the surface of the image retainer 30 and to remove therefrom.

On the other hand, the leading end of the aforementioned blade 39A is curved, when forced into contact with the image retainer 30, to bite into hairs 3901A of the aforementioned rotating brush member 3901. In other words, the hairs 3901A are held in forced contact with the surface of the image retainer 30 and the leading end of the blade 39A so that they enter a wedge-shaped space S which is defined by the image retainer 30 and the leading end of the blade 39A.

The hairs 3901A of the rotating brush member 3901 are bent to stream into the surface of the image retainer 30 so that they can contact with the leading end of the blade 39A evenly in the aforementioned wedge-shaped space S.

The aforementioned metal roller 3902 is a hard rod having a rigidity and a diameter of about 10 mm and a length corresponding substantially to the width of the aforementioned rotating brush 3901. The metal roller 3902 thus constructed is disposed to bite about 1 to 2 mm into the circle, which is formed by the free ends of the hairs 3901A of the rotating brush member 3901, i.e., the outer circumference of the rotating brush member 3901 so that it may beat the hairs 3901A uniformly all over the length of the rotating brush member 3901.

Below the rotating brush member 3901, i.e., in the lower portion of the aforementioned cleaning device 39, there is disposed the toner conveyor screw 3903 so that the toner dropped from a scraping plate 3902A of the aforementioned metal rod 3902 onto the toner conveyor screw 3903 is accommodated through a not-shown conduit into a waste toner box disposed below.

In the lower end portion of the frame 3904 and in the vicinity of the image retainer 30, on the other hand, there is fixed a base of the afore-mentioned shielding plate 3909. This shielding plate 3909 is constructed of an elastic thin plate made of polyethylene terephthalate (PET) and has its leading end portion disposed in light contact or in the vicinity of the surface of the image retainer 30 to prevent the toner from coming out of the cleaning device 39.

At a timing for a new image forming cycle after the end of the cleaning operation, the aforementioned cam member 3908 is turned half rotation clockwise, for example, to cause the cylindrical surface to move the square hole 3904A of the frame 3904 leftward.

As a result, the aforementioned frame 3904 is turned counter-clockwise a predetermined angle, as shown in FIG. 5(*b*), against the actions of the tensile springs 3906 to release the cleaning means (device) from the forced contact with the image retainer 30. As a result, the aforementioned blade 39A, rotating brush member 3901 and shielding member 3909 are retracted apart from the circumference of the image retainer 30 to open the image forming surface so that a subsequent image forming process can be started.

When the aforementioned cartridge 3 is to be taken out from the apparatus body 2, it is guided by the aforementioned guide member 4 to move in parallel to the front of the apparatus body 2 until it can be extracted. What phase the rotational angle of the aforementioned cam member 3908 might take, the aforementioned frame 3904 can be easily disengaged and disconnected from the cam member 3908.

Even if the frame 3904 has its cleaning member released from the forced contact with the image retainer 30, as shown in FIG. 5(*b*), or the cleaning member is released from the forced contact with the image retainer after the image formation has been completed in the image forming apparatus wherein the cleaning member is always released when the image formation or the cleaning operation is carried out, for example, its cleaning member is brought into the forced contact with the image retainer 30, as shown in FIG. 5(*a*), by the action of the tensile springs 3906 simultaneously with the take-out of the cartridge 3.

As a result, in case the cartridge 3 is in the separate state in which it is taken out from the apparatus body 2, the individual cleaning members always press the circumference of the image retainer 30. The residual toner can be effectively prevented from being dropped and scattered while the cartridge 3 is being mounted or demounted or being handled. Moreover, the image retainer 30 is held in its stable position by the individual cleaning members.

On the other hand, the forced contact of the cleaning means with the image retainer 30 accompanying the removal of the cartridge 3 can be effected independently of the phase of the rotational angle of the aforementioned cam member 3908. Even in case the cartridge 3 is taken out after the copying operation is interrupted at an arbitrary timing for remedying the trouble or the like, the individual cleaning members can be held in the forced contact to prevent the leakage of the residual toner in advance.

When the cartridge 3 having its cleaning members pressing the surface of the image retainer 30 is mounted on the apparatus body 2 to engage the cam member 3908 which is in the phase of the rotational angle to release the forced contact of the cleaning means, as shown in FIG. 5(*b*), the frame 3904 is so guided by the slope of a taper portion 3908A, which is formed at the leading end of the cam member 3908, while the square hole 3904B of the frame 3904 is inserted on the taper portion 3908A, as to turn counter-clockwise. At last, the frame 3904 comes into complete engagement with the cam member 3908 to restore the state in which the forced contact of the cleaning means is released.

The present invention has been described hereinbefore in connection with the color image forming apparatus a plurality of toner images are superposed on the image retainer and transferred to the transfer paper. However, the present invention should not be limited to that embodiment but can also be applied to a color image forming apparatus in which the image retainer and the cleaning means can be removably mounted as the process cartridge in the apparatus body even if only one developing device is disposed around the circumferential edge of the image retainer to form a monochromatic color image.

Further, as the image retainer not only the photosensitive drum in the above embodiment but also a photosensitive belt can be used. Furthermore, in the above embodiment, a cleaning blade is used as the main cleaning member. However, the present invention should not be limited thereto, and a cleaning roller, such as magnetic brush or fur brush can also be used.

According to the present invention, the image forming apparatus adopting the cartridge system including cleaning device can be effectively prevented from having its residual toner dropped or scattered, as might otherwise be caused when the cartridge is mounted or demounted. Thus, it is possible to provide a color image forming apparatus which is excellent in handling properties such that it can be cleanly maintained without blotting the hands, cloths or floors.

The present invention can exhibit its effects better if it is applied to the image forming apparatus adopting the halved clamshell structure in which the upper body accommodating the cartridge is highly tilted.

What is claimed is:

1. A color image forming apparatus having a body, an image retainer, a cleaning member for removing residual toner particles from said image retainer, and retaining means for releasably retaining said cleaning member in contact with said image retainer, the apparatus comprising:

a process unit assembly containing said image retainer, said cleaning member, and said retaining means, said process unit being removable from said body, retraction means on said body for selectively releasing said cleaning member from contact with said image retainer, and means for rendering said retraction means inoperative upon removal of said process unit to insure that said cleaning member is in contact with said image retainer when said process unit has been removed from said body.

2. The color image forming apparatus according to claim 1, wherein said cleaning member is a cleaning

3. The color image forming apparatus according to claim 1, wherein said process unit further comprises a plurality of developing devices.

4. A color image forming apparatus having a body, an image retainer, a cleaning device including at least one cleaning member, and means for releasably retaining said at least one cleaning member in pressure contact with said image retainer, the apparatus comprising:

a process unit containing said image retainer, said cleaning member, and said releasable retaining means, said process unit being removable from said body, and means on said body for selectively releasing said cleaning member from contact with said image retainer when said process unit is in said body, said last mentioned means being separated from said process unit upon removal thereof from said body, wherein said retaining means causes said cleaning member to be in pressure contact with said image retainer when said process unit has been removed from said body.

5. The color image forming apparatus according to claim 4, wherein said process unit further comprises a plurality of developing devices.

6. The color image forming apparatus according to claim 5, wherein said at least one cleaning member is a cleaning blade.

7. The color image forming apparatus according to claim 5, wherein said at least one cleaning member is a cleaning blade and a shielding plate.

8. The color image forming apparatus according to claim 5, wherein said at least one cleaning member is a cleaning blade, a shielding plate and a rotating brush member.

* * * * *

UNITED STATES PATENT AND TRADEMARK OFFICE

CERTIFICATE OF CORRECTION

PATENT NO. : 5,107,304

DATED : April 21, 1992

INVENTOR(S) : Satoshi Haneda et al.

It is certified that error appears in the above-identified patent and that said Letters Patent is hereby corrected as shown below:

Claim 2, column 12, line 2, after "cleaning" (second occurrence) insert --blade.--.

Claim 6, column 12, line 28, change "claim 5" to --claim 4--.

Claim 7, column 12, line 31, change "claim 5" to --claim 4--.

Claim 8, column 12, line 34, change "claim 5" to --claim 4--.

Signed and Sealed this

Fourteenth Day of September, 1993

Bruce Lehman

*Attest:*

BRUCE LEHMAN

*Attesting Officer*

*Commissioner of Patents and Trademarks*